US011701554B2

(12) United States Patent
Matsunaga et al.

(10) Patent No.: US 11,701,554 B2
(45) Date of Patent: Jul. 18, 2023

(54) GOLF CLUB HEAD

(71) Applicant: SUMITOMO RUBBER INDUSTRIES, LTD., Hyogo (JP)

(72) Inventors: Kiyofumi Matsunaga, Hyogo (JP); Tomohiro Hana, Hyogo (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 17/375,238

(22) Filed: Jul. 14, 2021

(65) Prior Publication Data

US 2022/0032134 A1 Feb. 3, 2022

(30) Foreign Application Priority Data

Jul. 30, 2020 (JP) ..... 2020-129531

(51) Int. Cl.
*A63B 53/04* (2015.01)

(52) U.S. Cl.
CPC ..... *A63B 53/0416* (2020.08); *A63B 53/0458* (2020.08); *A63B 53/047* (2013.01); *A63B 53/0466* (2013.01)

(58) Field of Classification Search
CPC ..... A63B 53/0416; A63B 53/0458; A63B 53/047; A63B 53/0466; A63B 60/52; A63B 60/54
USPC ..... 473/324–350, 287–292
See application file for complete search history.

(56) References Cited

U.S. PATENT DOCUMENTS 5,303,922 A * 4/1994 Lo ..... A63B 53/04 473/330
5,720,673 A * 2/1998 Anderson ..... A63B 60/00 473/324
5,743,813 A * 4/1998 Chen ..... A63B 53/0466 473/345
6,231,458 B1 * 5/2001 Cameron ..... A63B 53/0487 473/332
6,364,789 B1 * 4/2002 Kosmatka ..... A63B 53/0466 473/345
7,022,031 B2 * 4/2006 Nishio ..... A63B 53/047 473/349
7,025,693 B2 * 4/2006 Sugimoto ..... A63B 60/00 473/349

(Continued)

FOREIGN PATENT DOCUMENTS

JP 6484540 B2 3/2019

*Primary Examiner* — Sebastiano Passaniti
(74) *Attorney, Agent, or Firm* — Greenblum & Bernstein, P.L.C.

(57) ABSTRACT

A golf club head includes a face plate including a plate front surface constituting a club face, a plate rear surface opposite the plate front surface and having an outer peripheral portion, and a plate side surface, and a head main body being provided with an opening to receive the face plate and a receiving surface formed around a periphery of the opening to support the outer peripheral portion of the plate rear surface. The receiving surface is formed with a partially interrupted discontinuity so that the outer peripheral portion has a non-supported region that is not directly supported by the head main body. A portion of the plate side surface corresponding to the non-supported region is not directly supported by the head main body. The face plate is fixed to the head main body by a plastic deformation portion of the head main body.

16 Claims, 14 Drawing Sheets

(56) References Cited

U.S. PATENT DOCUMENTS

| | | | | |
|---|---|---|---|---|
| 7,413,517 | B2 * | 8/2008 | Butler, Jr | A63B 53/04 473/330 |
| 7,604,550 | B1 * | 10/2009 | Currie | A63B 53/047 473/342 |
| 7,686,706 | B2 * | 3/2010 | Matsunaga | A63B 53/0466 473/346 |
| 7,871,338 | B2 * | 1/2011 | Nakano | A63B 53/04 473/332 |
| 8,485,918 | B2 * | 7/2013 | Roach | A63B 53/04 473/332 |
| 8,708,837 | B2 * | 4/2014 | Roach | A63B 53/04 473/332 |
| 8,777,776 | B2 * | 7/2014 | Wahl | A63B 53/047 473/345 |
| 8,920,259 | B2 * | 12/2014 | Takechi | A63B 60/02 473/332 |
| 10,029,157 | B2 * | 7/2018 | Sugimoto | A63B 53/047 |
| 10,173,107 | B2 * | 1/2019 | Norimura | A63B 53/0475 |
| 10,369,431 | B2 * | 8/2019 | Nakamura | A63B 53/047 |
| 10,543,409 | B2 * | 1/2020 | Demkowski | A63B 60/52 |
| 2003/0054901 | A1 * | 3/2003 | Sun | A63B 53/047 473/350 |
| 2008/0004131 | A1 * | 1/2008 | Lin | A63B 60/00 473/342 |
| 2014/0274454 | A1 * | 9/2014 | Snyder | A63B 53/047 473/332 |
| 2017/0113109 | A1 | 4/2017 | Kohno et al. | |

* cited by examiner

GOLF CLUB HEAD

This application claims the benefit of foreign priority to Japanese Patent Application No. JP2020-129531, filed Jul. 30, 2020, which is incorporated by reference in its entirety.

BACKGROUND ART

Field of the Disclosure

The present disclosure relates to a golf club head.

Description of the Related Art

The following Patent document 1 discloses a golf club head. The golf club head includes a head main body and a face plate fixed to the head main body. A part of a rear surface of the face plate is configured so as not to contact a receiving surface of the head main body.

PATENT DOCUMENT

[Patent document 1] Japanese Patent 6484540

SUMMARY OF THE DISCLOSURE

The golf club head according to Patent document 1 has excellent rebound performance, but in recent years, further improvement of the rebound performance of the golf club head has been required.

The present disclosure has been made in view of the above circumstances and has a major object to provide a golf club head that can further improve the rebound performance.

In one aspect of the disclosure, a golf club head includes a face plate including a plate front surface constituting a club face at least partially, a plate rear surface opposite the plate front surface and having an outer peripheral portion, and a plate side surface extending between the plate front surface and the plate rear surface, and a head main body being provided with an opening to receive the face plate and a receiving surface formed around a periphery of the opening to support the outer peripheral portion of the plate rear surface, wherein the receiving surface is formed with a partially interrupted discontinuity so that the outer peripheral portion has a non-supported region that is not directly supported by the head main body, a portion of the plate side surface corresponding to the non-supported region is not directly supported by the head main body, and the face plate is fixed to the head main body by a plastic deformation portion of the head main body.

In another aspect of the disclosure, the non-supported region may be formed on a lower side of the face plate and extends to an outer surface of a sole of the golf club head.

In another aspect of the disclosure, the plastic deformation portion of the head main body may cover at least a portion of the plate front surface of the face plate.

In another aspect of the disclosure, the face plate may have a difference between a maximum thickness thereof and a minimum thickness thereof of 2.0 mm or less.

In another aspect of the disclosure, the non-supported region may extend in a toe-heel direction of the golf club head so as to across a vertical plane orthogonal to the club face and passing through a face center.

In another aspect of the disclosure, the non-supported region may include a toe-side non-supported region and a heel-side non-supported region, and the receiving surface may include a center receiving surface formed between the toe-side non-supported region and the heel-side non-supported region.

In another aspect of the disclosure, the center receiving surface may extend in a toe-heel direction of the golf club head so as to across a vertical plane orthogonal to the club face and passing through a face center.

In another aspect of the disclosure, a gap may be formed between the non-supported region and the head main body with a distance in a direction orthogonal to the club face.

In another aspect of the disclosure, the distance of the gap may be constant in a toe-heel direction of the golf club head.

In another aspect of the disclosure, the distance of the gap may vary in the toe-heel direction, and a smallest portion of the gap with a smallest distance may be located between a toe-side end and a heel-side end of the non-supported region.

In another aspect of the disclosure, the distance may be set such that when the golf club head strikes a ball, the face plate and the head main body come into contact with each other at the smallest portion of the gap.

In another aspect of the disclosure, the smallest portion of the gap may be equal to or less than 1.0 mm.

In another aspect of the disclosure, a filling member may be arranged in at least a part of the gap.

In another aspect of the disclosure, the filling member may be arranged in an entire range of the non-supported region in the toe-heel direction.

In another aspect of the disclosure, the filling member may be arranged only in a part of the non-supported region in the toe-heel direction.

In another aspect of the disclosure, Young's modulus of the filling member may be smaller than Young's modulus of the face plate and the head main body.

In another aspect of the disclosure, a specific gravity of the filling member may be larger than specific gravities of the face plate and the head main body.

In another aspect of the disclosure, the club head may have a wood, hybrid or iron head shape.

DESCRIPTION OF THE PREFERRED EMBODIMENTS

Figure 1:
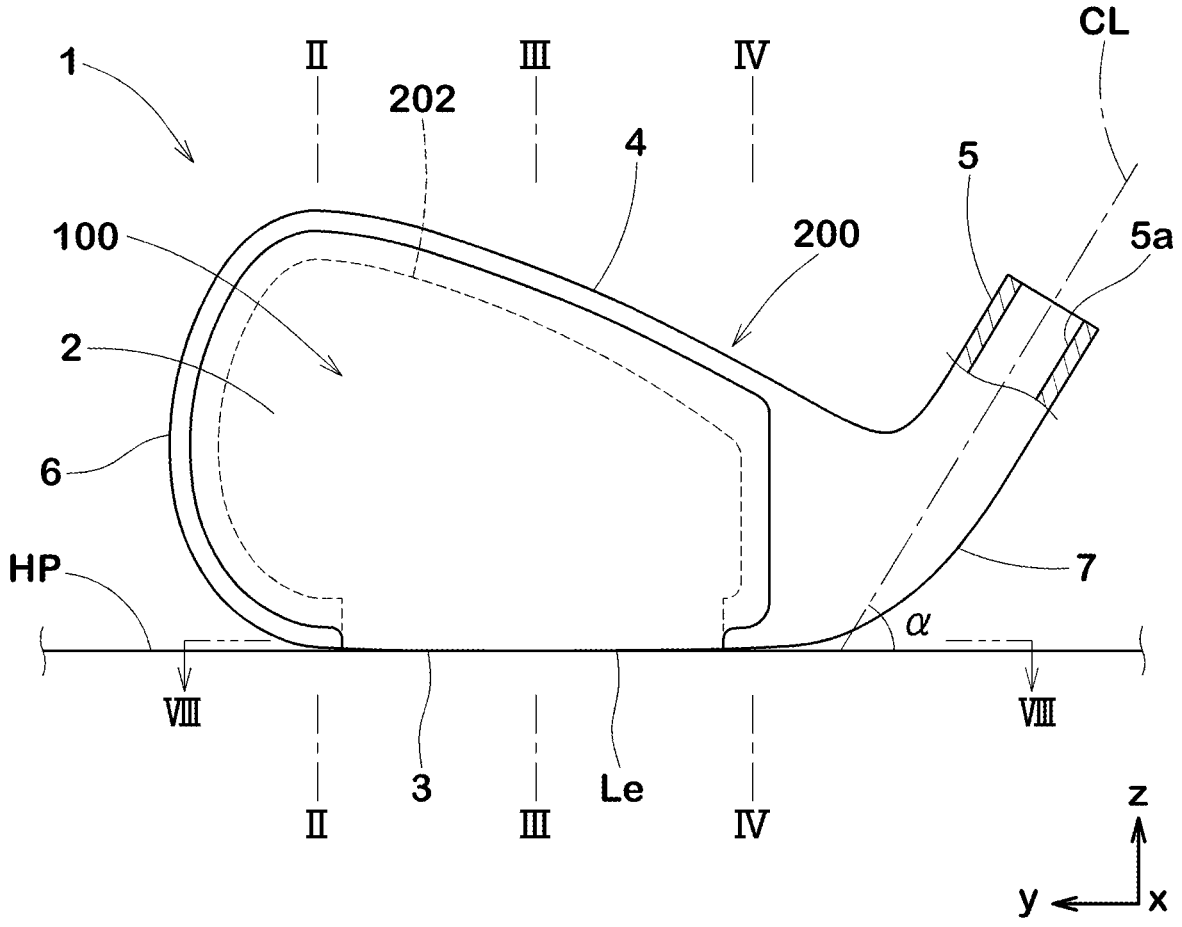
FIG. 1 is a front view of a golf club head according to an embodiment.

An embodiment of the present disclosure will be explained below with reference to the accompanying drawings.

It should be noted that the drawings are intended to aid in the understanding of the present disclosure and may contain representations that differ from the dimensional ratios of the actual structure. Moreover, in a plurality of embodiments, the same or common elements are denoted by the same reference numerals throughout the specification, and duplicate explanations have been omitted.

Figure 4:
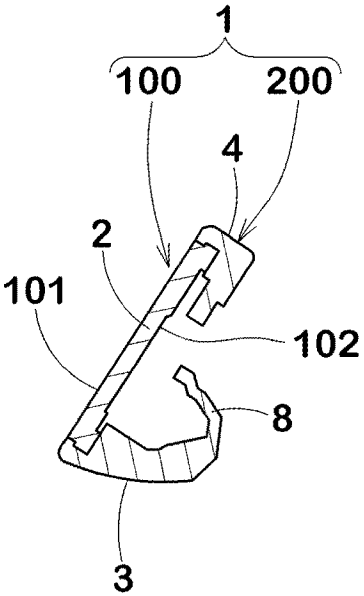
FIG. 4 is a cross-sectional view taken along the lines IV-VI of FIG. 1.
Figure 2:
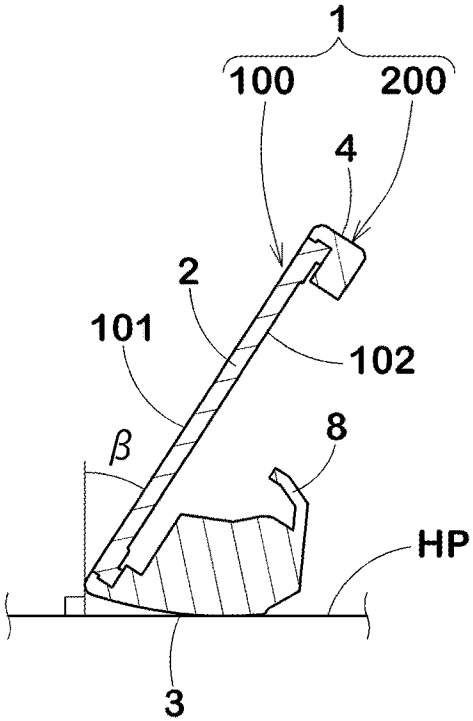
FIG. 2 is a cross-sectional view taken along the lines II-II of FIG. 1.
Figure 5:
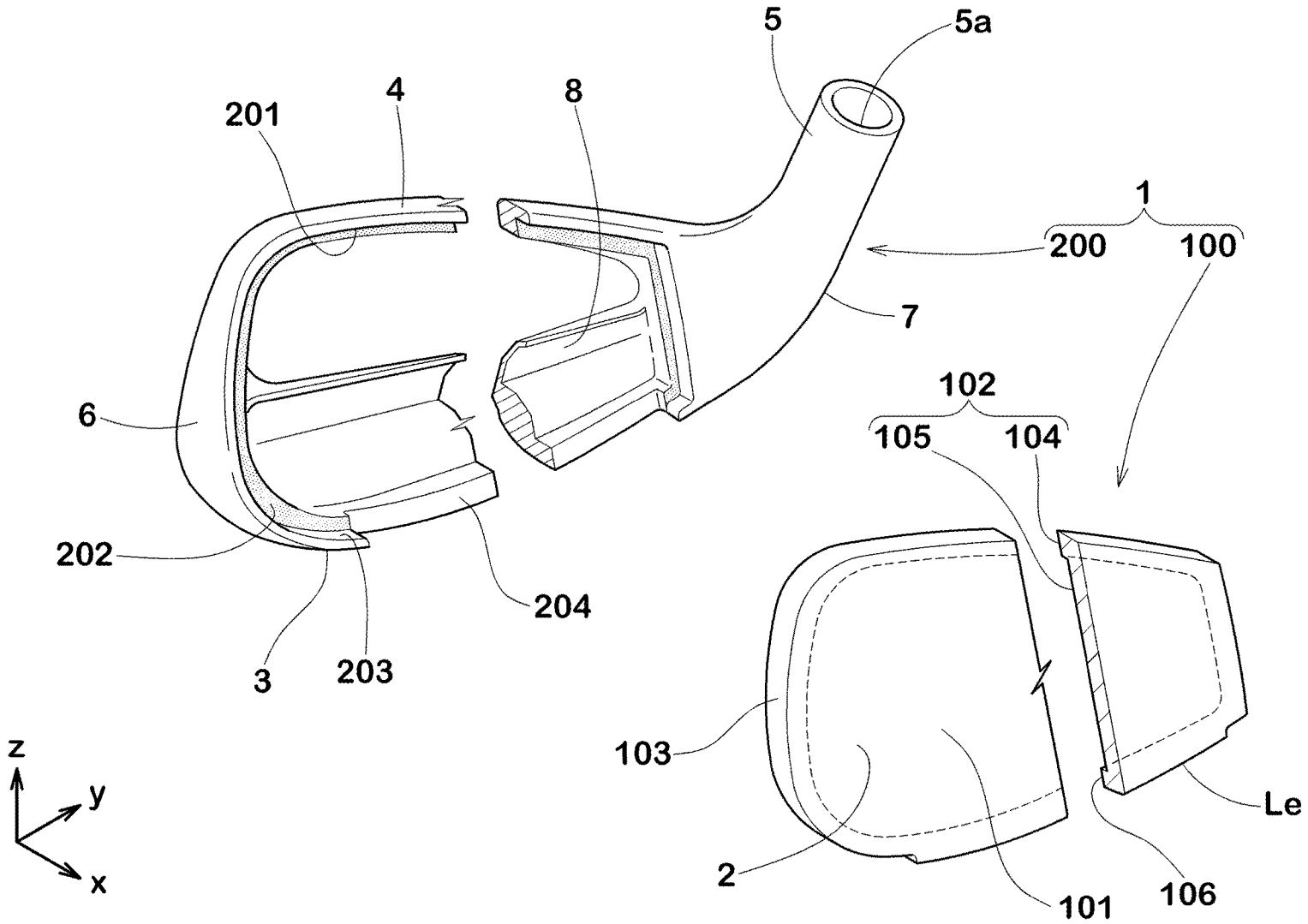
FIG. 5 is an exploded perspective view of the golf club head according to the embodiment.

FIG. 1 illustrates a front view of a golf club head 1 (hereinafter simply referred to as the "head") according to the present embodiment, and FIGS. 2 to 4 respectively illustrate cross-sectional views taken along the lines II-II, III-III, and IV-IV of FIG. 1. Further, FIG. 5 illustrates an exploded perspective view of the head 1.

[Reference State]

In FIG. 1, the head 1 is shown as being in the reference state. As used herein, the "reference state" of the head 1 means a state in which the head 1 is placed on a horizontal plane HP at its lie angle α (FIG. 1) and loft angle β (FIG. 2) of the head 1. In the reference state, the head 1 is held at the lie angle α and the loft angle β with a virtual shaft central axis CL of the head 1 arranged in a reference vertical plane (not illustrated) perpendicular to the horizontal plane HP. The "virtual shaft central axis CL" is defined by the central axis of the shaft insertion hole 5*a* of the hosel 5 of the head 1. Unless otherwise noted, all club head dimensions described herein are taken with the head 1 in the reference state.

[Club Head Direction]

As used herein, in the reference state of the head 1, "front-back direction" of the head is a direction x orthogonal to the reference vertical plane. In the front-back direction of the head, the club face 2 side is the front side, and the opposite side is the rear side. Further, "Toe-heel direction" is a direction y parallel to both the reference vertical plane and the horizontal plane HP. Furthermore, "head vertical direction" is a direction z orthogonal to the horizontal plane HP.

[Basic Structure of Head]

As illustrated in FIGS. 1 to 5, the head 1 according to the present embodiment includes the club face 2, a sole 3, a top 4, the hosel 5, a toe 6, a heel 7, and a rear wall 8. In the present embodiment, the head 1 is configured as an iron golf club head, more specifically, a cavity back iron golf club head, for example. In another embodiment, the head 1 may be configured as a wood type or hybrid head.

The club face 2 is a surface for striking a ball. Although not illustrated, the club face 2 may be provided with one or more face grooves that extend in the toe-heel direction. The club face 2 according to the present embodiment provides a striking face that forms a single flat surface except for the face grooves.

The sole 3 is a bottom surface of the head 1 extending rearward of the head 1 from the lower edge of the club face 2.

The top 4 is an upper surface of the head 1 extending rearward of the head 1 from the upper edge of the club face 2. The top 4 may be customarily referred to as "crown".

The hosel 5 is provided on the heel 7 side of the club face 2. In the present embodiment, the hosel 5 is formed in a tubular shape with the shaft insertion hole 5*a* to which a golf club shaft (not illustrated) is inserted.

The head 1 includes a face plate 100 and a head main body 200.

[Face Plate]

The face plate 100 has a plate-like shape, and includes a plate front surface 101 constituting the club face 2 at least partially, a plate rear surface 102 opposite the plate front surface 101, and a plate side surface 103 extending between the plate front surface 101 and the plate rear surface 102.

In the face plate 100, the size and shape of the plate front surface 101 are appropriately determined in order to provide a sufficiently large striking area. The face plate 100 according to the present embodiment constitutes 50% or more of the area of the club face 2. In addition, the face plate 100 according to the present embodiment includes a portion extending to the sole 3 so as to form a part of the leading edge Le in order to expand the high rebound region toward the sole 3.

The plate rear surface 102 includes an outer peripheral portion 104 extending continuously along its outer peripheral edge and a central portion 105 surrounded by the outer peripheral portion 104.

Figure 3:
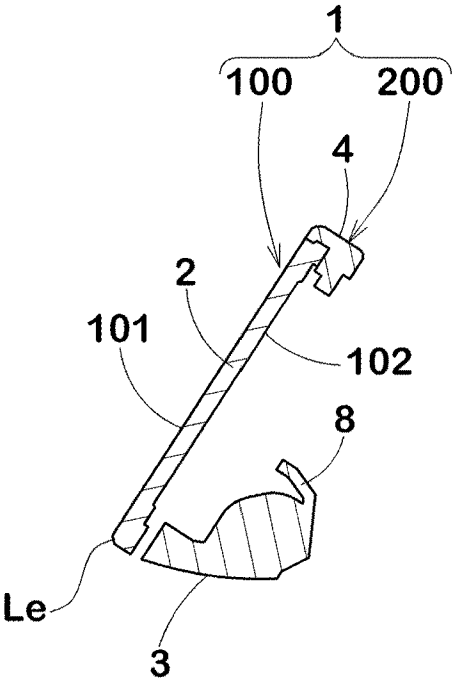
FIG. 3 is a cross-sectional view taken along the lines III-III of FIG. 1.
Figure 6:
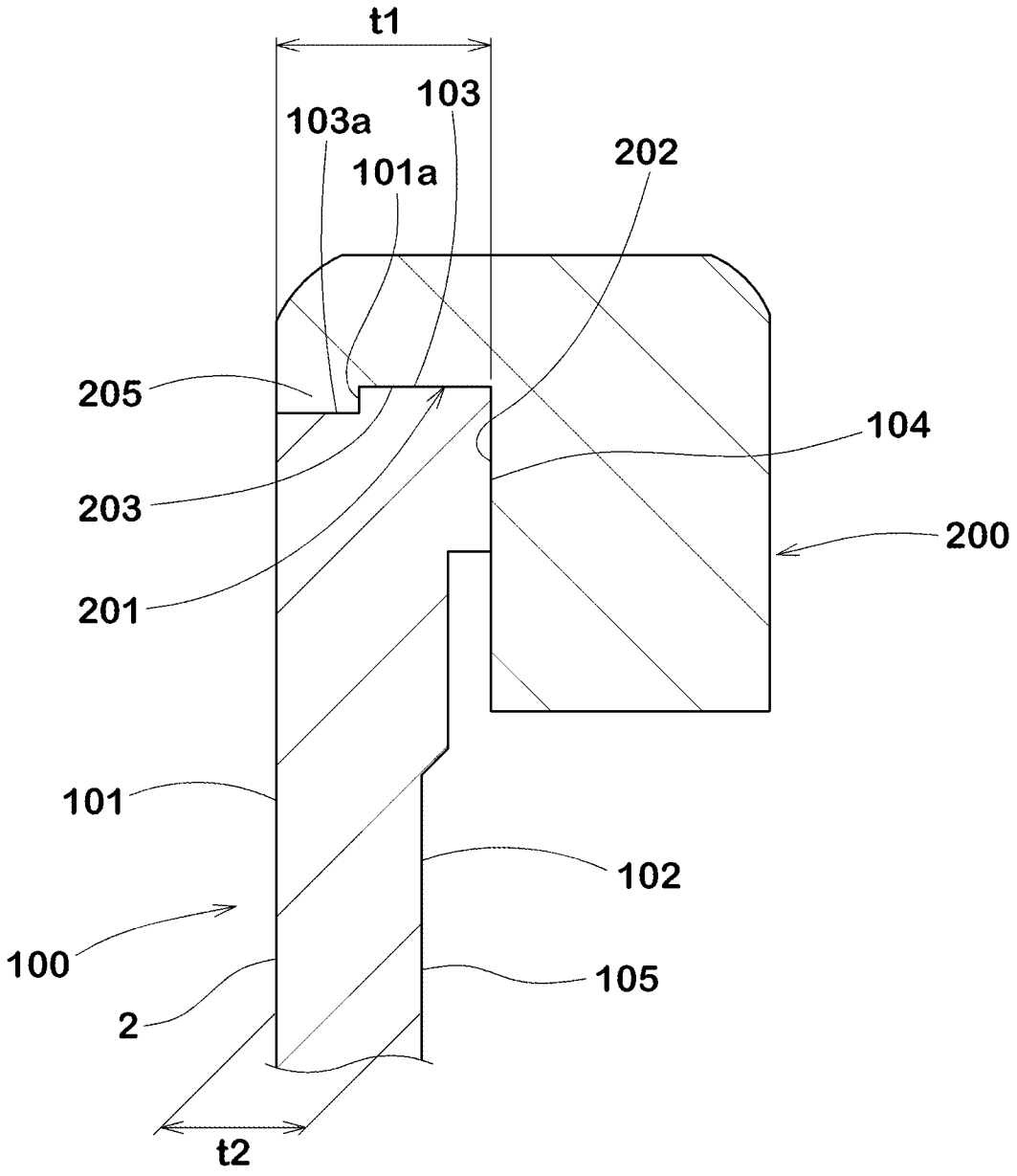
FIG. 6 is an enlarged view of an upper part of FIG. 2.

FIG. 6 illustrates an enlarged view of an upper part of FIG. 3. As illustrated in FIG. 6, in the present embodiment, a thickness t1 of the peripheral portion 104 of the face plate 100 is formed slightly greater than a thickness t2 of the central portion 105 of the face plate 100. In another embodiment, the thickness t1 of the peripheral portion 104 may be the same as the thickness t2 of the central portion 105.

The face plate 100 is made of, for example, a metallic material. The metallic material is not particularly limited, but in consideration of resilience, durability, etc., for example, stainless steel, maraging steel, titanium alloy, etc. may be employed. The face plate 100 according to the present embodiment is made of a titanium alloy. The titanium alloy is not particularly limited, and for examples, α-titanium, α-titanium and α+β-titanium may be adopted.

[Head Main Body]

As illustrated in FIGS. 1 to 5, the head main body 200, for example, includes the sole 3, the top 4, the hosel 5, the toe 6 and the heel 7. In the head main body 200 according to the present embodiment, these elements are formed integrated with one another. The head main body 200 is made of, for example, a metallic material. The metallic material is not particularly limited, but in consideration of strength, for example, stainless steel, soft iron, etc. may be adopted. The head main body 200 according to the present embodiment is made of stainless steel.

As illustrated in FIG. 5, the head main body 200 is provided with an opening 201 to receive the face plate 100, and a receiving surface 202 formed around a periphery of the opening 201 to support the outer peripheral portion 104 of the plate rear surface 102. To help understanding, the receiving surface 202 is colored in FIG. 5.

As illustrated in FIG. 5 and FIG. 6, the head main body 200, for example, further includes an opening surface 203 extending rearward from the club face 2 so as to surround the opening 201. The opening surface 203 is a surface that faces the plate side surface 103 of the face plate 100. The size, shape, etc. of the opening 201 may be determined appropriately so as to accept the face plate 100.

The receiving surface 202 supports the peripheral portion 104 of the plate rear surface 102 of the face plate 100 from the rear side of the head. The receiving surface 202 according to the present embodiment is a surface extending stepwise from the opening surface 203 to the inside of the head. In this embodiment, the receiving surface 202 extends parallel to the club face 2.

Figure 7:
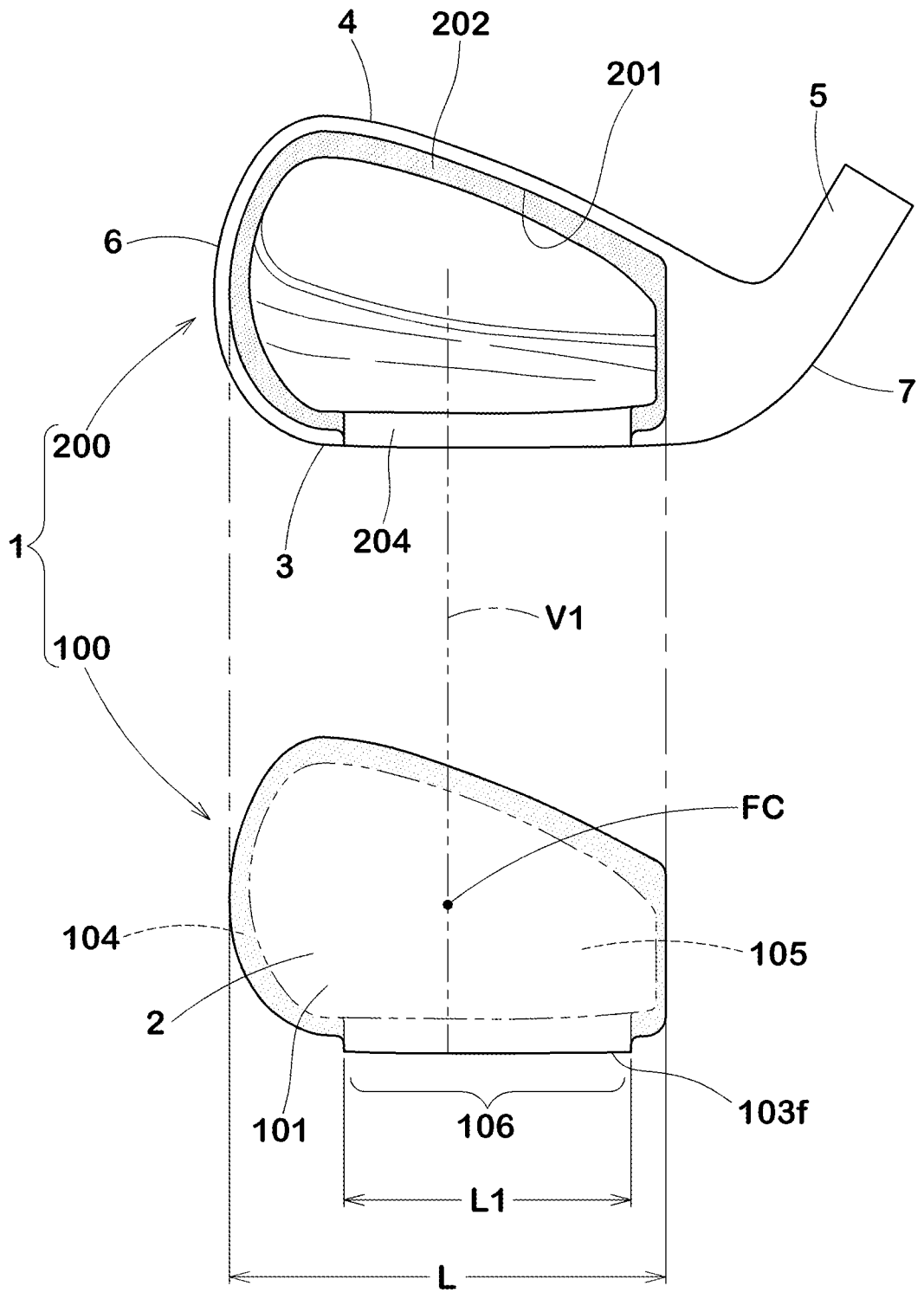
FIG. 7 is an exploded front view of the golf club head according to the embodiment.

FIG. 7 illustrates an exploded front view of the head 1 according to the present embodiment, and which shows the head main body 200 on the upper side and the face plate 100 on the lower side separately. These are aligned with each other in the toe-heel directions. Also, to help understanding, the receiving surface 202 is lightly colored in FIG. 7.

As illustrated in FIG. 7, the receiving surface 202 according to the present embodiment extends from the toe 6 side to the heel 7 side through the top 4 side. On the other hand, the receiving surface 202 is formed with a partially interrupted discontinuity around the opening 201. In the present embodiment, the receiving surface 202 includes a discontinuous portion thereof on the sole 3 side. The discontinuous portion is a recessed surface 204 located behind the head from the receiving surface 202. The recessed surface 204 does not contact the peripheral portion 104 of the plate rear surface 102 of the face plate 100.

[Non-Supported Region of Face Plate]

A part of the peripheral portion 104 of the face plate 100 (in this embodiment, the toe 6 side, the top 4 side and the heel 7 side) is supported by the receiving surface 202. In FIG. 7, to help understanding, the portion directly supported by the head main body 200 (that is, the portion supported by the receiving surface 202) is colored.

On the other hand, the peripheral portion 104 of the face plate 100 includes a non-supported region 106 which is not directly supported by the head main body 200. A portion 103*f* of the plate side surface 103 that corresponds to the non-supported region 106 is also not supported by the head main body 200. Note that the portion 103*f* of the plate side surface 103 corresponding to the non-supported region 106 means a portion of the plate side surface connected to the non-supported region 106. Thus, in FIG. 7, the portion 103*f* of the plate side surface 103 corresponding to the non-supported region 106 coincides with the range of the non-supported region 106.

Figure 8:
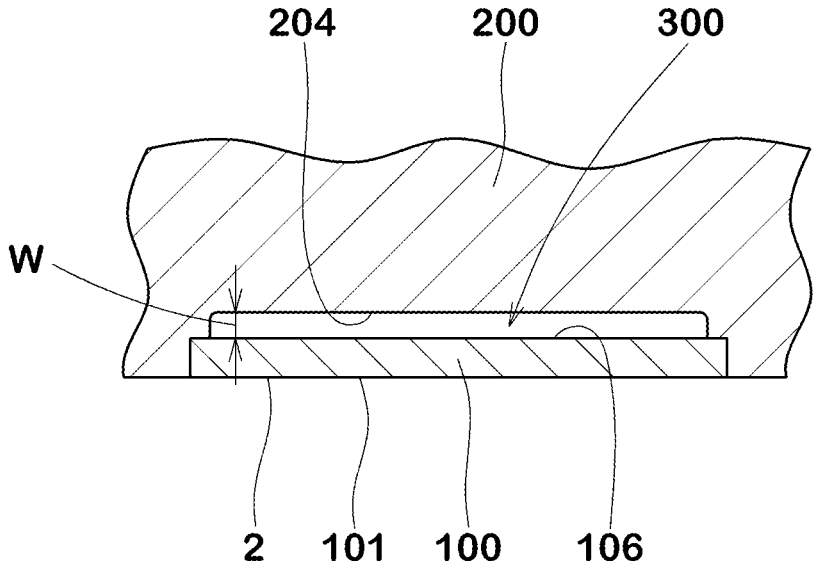
FIG. 8 is a cross-sectional view taken along the lines VIII-VIII of FIG. 1.
Figure 9:
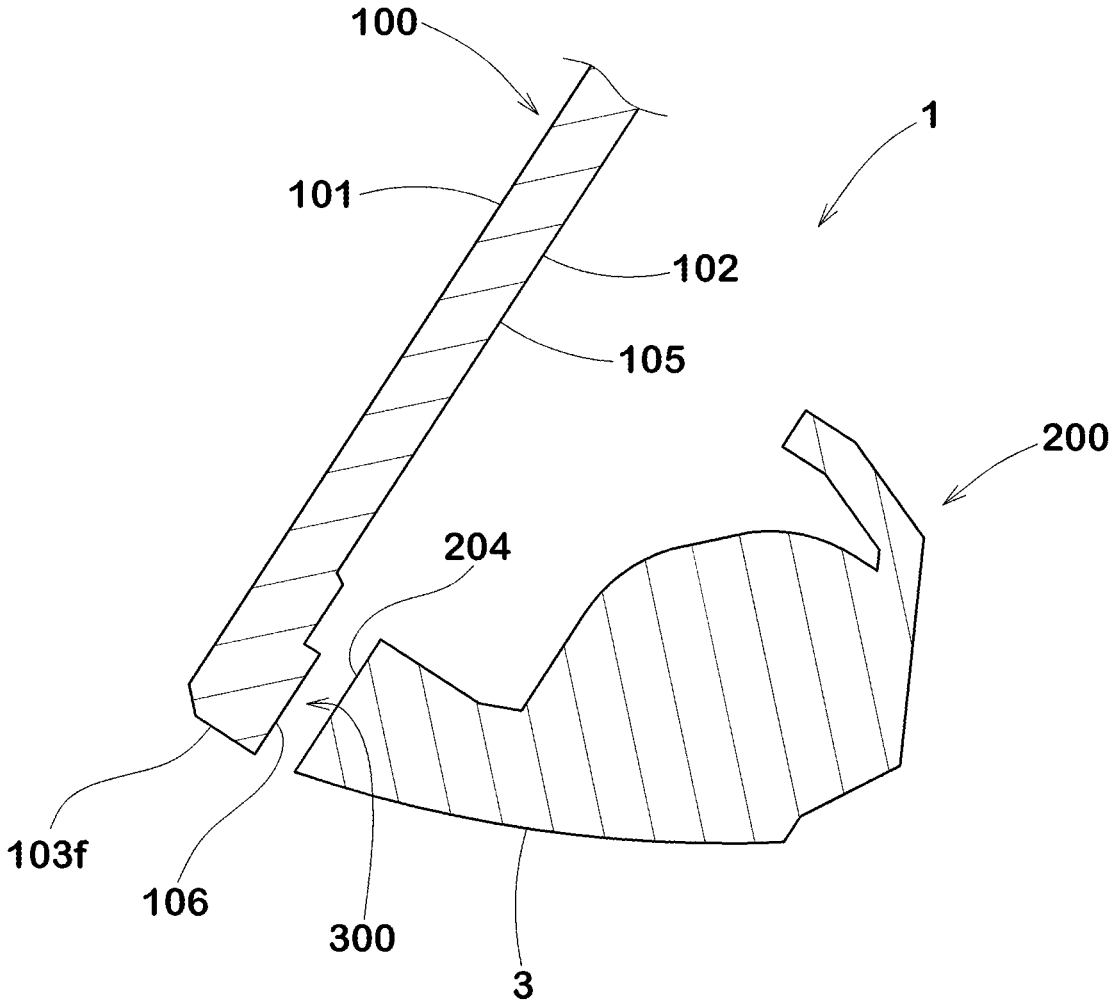
FIG. 9 is an enlarged view of a lower part of FIG. 3.

FIG. 8 illustrates a cross-sectional view taken along the lines VIII-VIII of FIG. 1, and FIG. 9 illustrates an enlarged view of a lower part of FIG. 3. As illustrated in FIG. 8 and FIG. 9, in the present embodiment, a gap 300 is formed between the non-supported region 106 and the head main body 200.

[Effect of Embodiment]

In the head 1 according to the present embodiment, the central portion 105 of the face plate 100, which is not directly supported by the head main body 200, is easily bent when striking a ball. Further, since the peripheral portion 104 of the face plate 100 includes the non-supported region 106 that is not directly supported by the head main body 200, the non-supported region 106 is also configured to be flexible. Furthermore, since the portion 103*f* of the plate side surface 103 corresponding to the non-supported region 106 is also not supported by the head main body 200, the non-supported region 106 of the club face 2 becomes more flexible. Thus, the head 1 according to the present embodiment can further improve rebound performance. In some preferred embodiments, the portion 103*f* of the plate side surface 103 is preferably not be directly nor indirectly supported by the head main body 200.

As illustrated in FIG. 9, in the present embodiment, the non-supported region 106 extends to an outer surface of the sole 3. That is, the portion 103*f* of the plate side surface 103 corresponding to the non-supported region 106 forms a part of an outer surface of the sole 3. Thus, the head 1 according to the present embodiment can provide a larger high rebound region to the sole 3 side. Such an embodiment is particularly suitable for iron-type heads, which often hit the ball on the sole 3 side of the club face 2. Hereinafter, some embodiments in which the non-supported region 106 is formed on the sole 3 side will be described. Alternatively, in other embodiments, the non-supported region 106 may be configured to extend to the other outer surface of the head, e.g., the toe 6 and/or the top 4 (not illustrated).

[Fixing Face Plate]

In the head 1 according to the present embodiment, the face plate 100 is fixed to the head main body 200 by caulking. Welding may be considered as a way to fix the face plate 100 to the head main body 200. However, when welding, heat during welding may change the metallographic structure of the face plate 100, reducing rebound performance thereof. On the other hand, when the face plate 100 is fixed to the head main body 200 by caulking, the above-mentioned heat effects can be avoided, resulting in preventing deterioration of the rebound performance of the head 1.

FIG. 6 shows an example in which the face plate 100 is fixed to the head main body 200 by caulking. As illustrated in FIG. 6, the plate side surface 103 of the face plate 100 is provided with a recess 103*a* that extends along the plate side surface 103 on the front side of the plate side surface 103. The front surface 101*a* of the recess 103*a* forms a part of the plate front surface 101. On the other hand, the head main body 200 comprises a plastic deformation portion 205 so as to cover the recess 103*a* of the face plate 100 (that is, to cover the front surface 101*a* which is at least a part of the plate front surface 101). After the face plate 100 is arranged to the opening 201 of the head main body 200, a part of the head main body 200 is plastically deformed by a press or the like so as to form the plastic deformation portion 205 filling the recess 103*a*. As a result, the face plate 100 is fixed to the head main body 200 by the plastic deformation portion 205.

[Face Plate Material]

In the present embodiment, the face plate 100 is made of a titanium alloy which has a specific gravity smaller than that of the head main body 200. Such an embodiment can make the face plate 100 located in front side of the head lighter, helping to provide a deeper head center of gravity. In addition, since the periphery of the face plate 100 is made of the head main body 200 which has a relatively large specific gravity, it is useful to provide the head 1 with a large moment of inertia in the vertical and horizontal directions.

In the present embodiment, the face plate 100 is made of a titanium alloy with a lower Young's modulus than that of the head main body 200. This also helps to make the face plate 100 more flexible and further improve its resilience.

Here, a combination of metal materials such as titanium alloy and stainless steel cannot form a welded joint with practical strength as a golf club head. Therefore, in order to provide the head 1 with a large moment of inertia and/or even better rebound performance without compromising durability, the face plate 100 and the head main body 200 may preferably be fixed by the above-mentioned caulking.

[Thickness of Face Plate]

A thickness of the face plate 100 (a thickness in the direction orthogonal to the club face 2 and the same applies hereinafter) is not particularly limited. In order to further improve rebound performance of the head 1, the maximum thickness of the face plate 100 is preferably equal to or less than 4.0 mm, more preferably equal to or less than 3.8 mm, still further preferably equal to or less than 3.5 mm, yet further preferably equal to or less than 3.3 mm. In the present embodiment, the maximum thickness of the face plate 100 is the thickness t1 of the peripheral portion 104, and which is 3.3 mm.

Further, in order to suppress deterioration of durability, the minimum thickness of the face plate 100 is preferably equal to or more than 1.6 mm, more preferably equal to or more than 1.8 mm, still further preferably equal to or more than 2.0 mm, yet further preferably equal to or more than 2.2 mm. In the present embodiment, the minimum thickness of the face plate 100 is the thickness t2 of the central portion 105, and which is 2.2 mm.

Preferably the difference between the maximum thickness and the minimum thickness of the face plate 100 is equal to or less than 2.0 mm, more preferably equal to or less than 1.8 mm, still further preferably equal to or less than 1.6 mm, yet further preferably equal to or less than 1.4 mm. In the present embodiment, the difference between the maximum thickness and the minimum thickness is 1.1 mm. In this way, by reducing the thickness difference of the face plate 100, bending rigidity of the face plate 100 is also made uniform, and the entire of the face plate 100 is easily bent. Thus, such a face plate 100 is sufficiently flexible as compared with the one provided with a folded back portion at the rear of the head, improving rebound performance of the head 1 further.

In other embodiments, the face plate 100 may be formed in a constant thickness. In this case, the maximum thickness and the minimum thickness of the face plate 100 are the same.

Example 1 of Non-Supported Region

In the embodiment shown in FIG. 7, the non-supported region 106 extends in the toe-heel direction through the face center FC and across the vertical plane V1 orthogonal to the club face 2. Such a head 1 can enhance the rebound performance in a wide range on the toe side and the heel side of the vertical plane V1 on the sole 3 side of the club face 2.

As used herein, the face center FC is the intermediate position of the face plate 100 in the vertical direction at the center position of the length L of the toe-heel direction of the face plate 100.

In order to improve rebound performance over a wider range of the toe-heel direction, a length L1 of the toe-heel direction of the non-supported region 106 is preferably equal to or more than 50% the length L of the toe-heel direction of the face plate 100, more preferably equal to or more than 55%, still further preferably equal to or more than 60%.

In order to suppress the decrease in joint strength between the face plate 100 and the head main body 200, the length L1 of the toe-heel direction of the non-supported region 106 is preferably equal to or less than 90% the length L of the toe-heel direction of the face plate 100, more preferably equal to or less than 80%, still further preferably equal to or less than 70%.

Example 2 of Non-Supported Region

Figure 10:
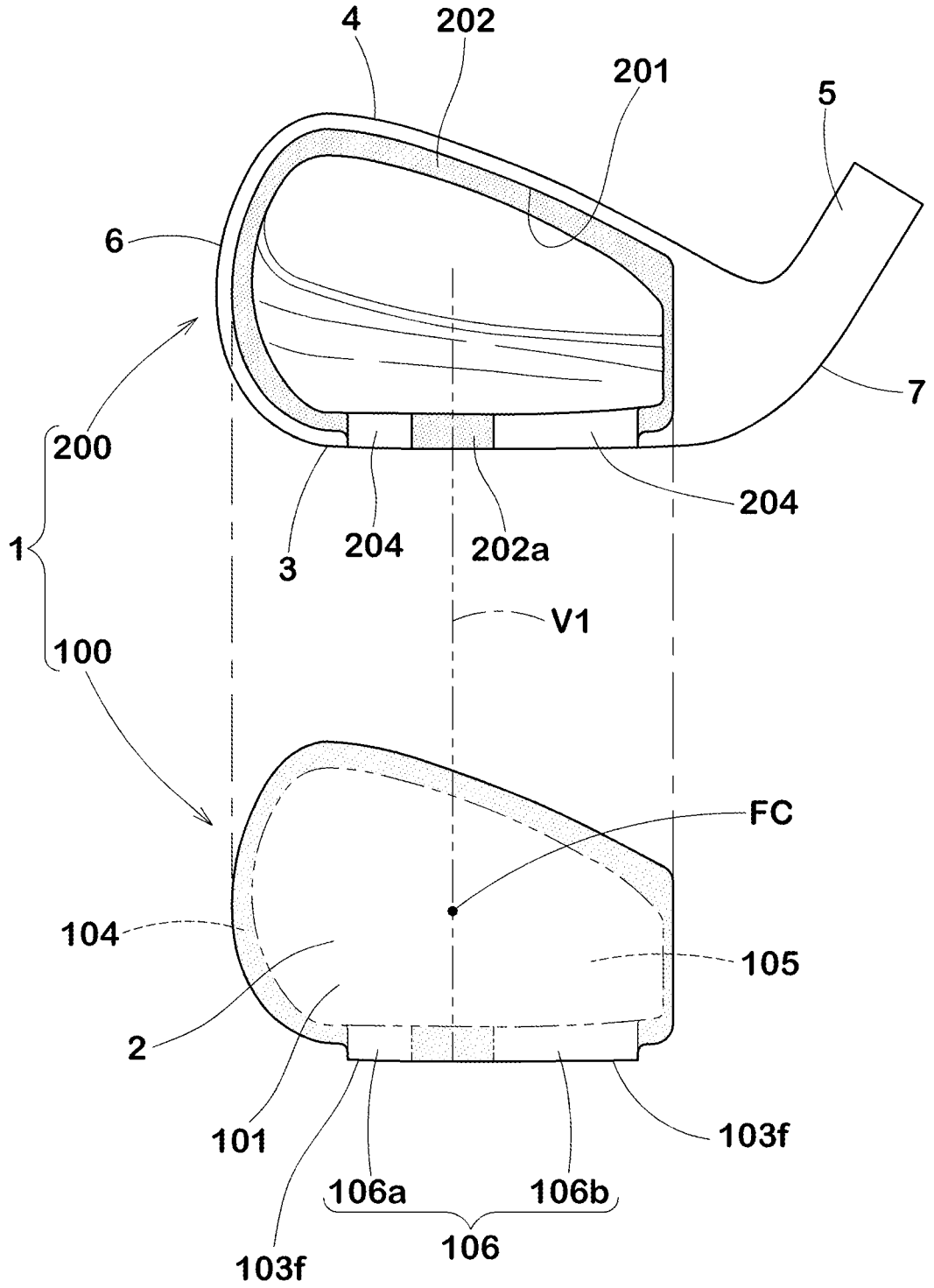
FIG. 10 is an exploded perspective view of the golf club head showing another example of a receiving surface.

FIG. 10 is an exploded perspective front view of the head 1 showing another example of the non-supported region 106. In the figure, the head main body 200 is shown on the upper side, and the face plate 100 is shown on the lower side, and which are aligned with each other in their toe-heel directions. Also, to help understanding, the receiving surface 202 is lightly colored in FIG. 10. Similarly, in the face plate 100, the part that is directly supported by the head main body 200 (i.e., the part supported by the receiving surface 202) is colored.

In this example, the non-supported region 106 includes a toe-side non-supported region 106*a* and a heel-side non-supported region 106*b* which are arranged separately from each other. On the other hand, the receiving surface 202 includes a center receiving surface 202*a* formed between the toe-side non-supported region 106*a* and the heel-side non-supported region 106*b*.

In general, rebound performance of the club face 2 is greatest near the face center FC even on the sole side, and tends to gradually decrease from there toward the toe 6 side and the heel 7 side. In this example, rebound on the toe 6 side and the heel 7 side of the club face 2 on the sole 3 side can be relatively high while suppressing rebound near the face center FC. Thus, this example can level the coefficient of restitution of the club face 2 in the toe-heel direction, and thus expands the high rebound area over the toe-heel direction.

[Example of Gap]

In the example shown in FIG. 8, a distance W of the gap 300 in the direction orthogonal to the club face 2 is constant in the toe-heel direction. In this example, the distance W of the gap 300 is set so that the non-supported region 106 of the face plate 100 does not contact the head main body 200 even if the face plate 100 bends when a golf ball is struck on the club face 2. The distance W of the gap 300, for example, is preferably equal to or more than 1.0 mm, more preferably equal to or more than 1.3 mm, further preferably equal to or more than 1.5 mm.

Figure 11:
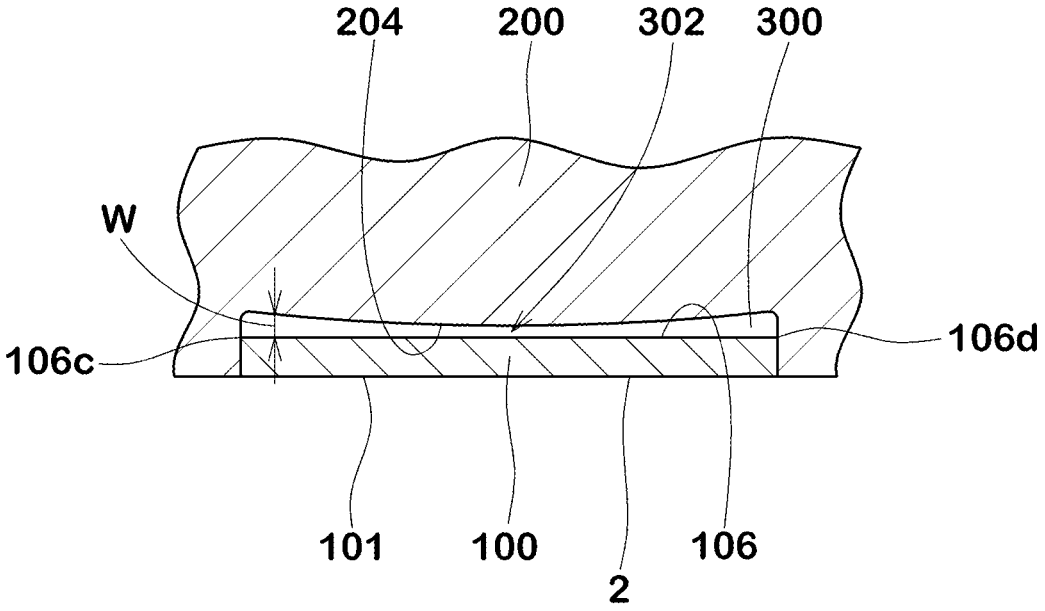
FIG. 11 is a cross-sectional view taken along the lines VIII-VIII of FIG. 1 showing another example of a gap.

FIG. 11 shows another example of the gap 300. FIG. 11 shows a cross-sectional view which corresponds to the location taken along the lines VIII-VIII of FIG. 1. In the example of FIG. 11, the distance W of the gap 300 varies in the toe-heel direction.

A smallest portion 302 which has the smallest distance W of the gap 300 is located between the toe side edge 106*c* and the heel side end 106*d* of the non-supported region 106. In this example, the distance W of the gap 300 decreases continuously from the toe side edge 106*c* and the heel side end 106*d* of the non-supported region 106 toward the center, but it may change in stages.

In some preferred embodiments, the distance W of the smallest portion 302 may be set such that the face plate 100 and the head main body 200 come into contact with each other when a golf ball is struck on the club face 2. The distance W of such the smallest portion 302, for example, is less than 1.0 mm, more preferably less than 0.5 mm.

In such a head 1, a part of the non-supported region 106 comes into contact with the head main body 200 due to the deformation of the face plate 100 when a golf ball is struck on the club face 2, and excessive deformation of the face plate 100 can be suppressed. Thus, this embodiment can adjust rebound performance of the head 1.

[Filling Member]

Figure 12:
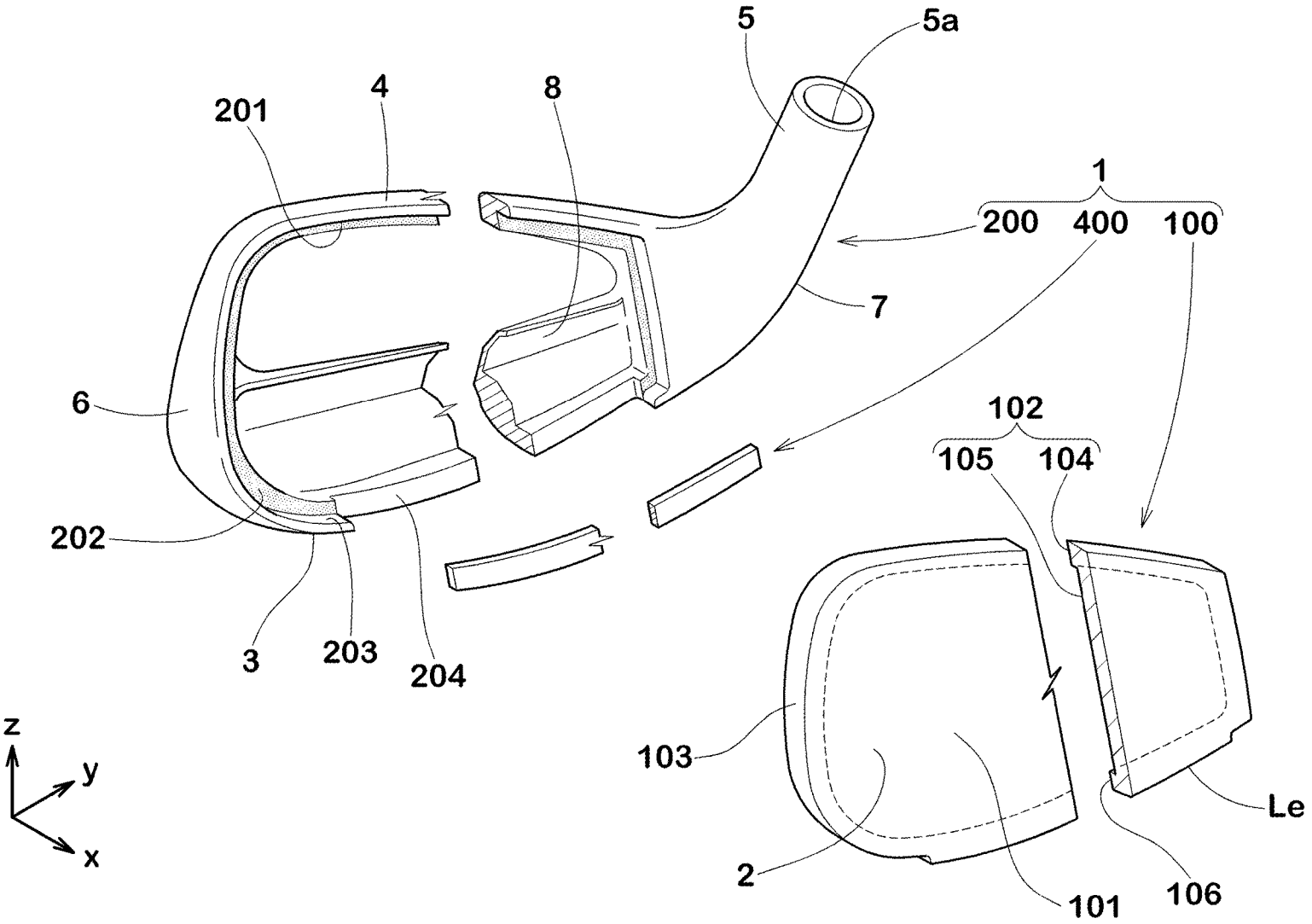
FIG. 12 is an exploded perspective view of the golf club head according to another embodiment.
Figure 13:
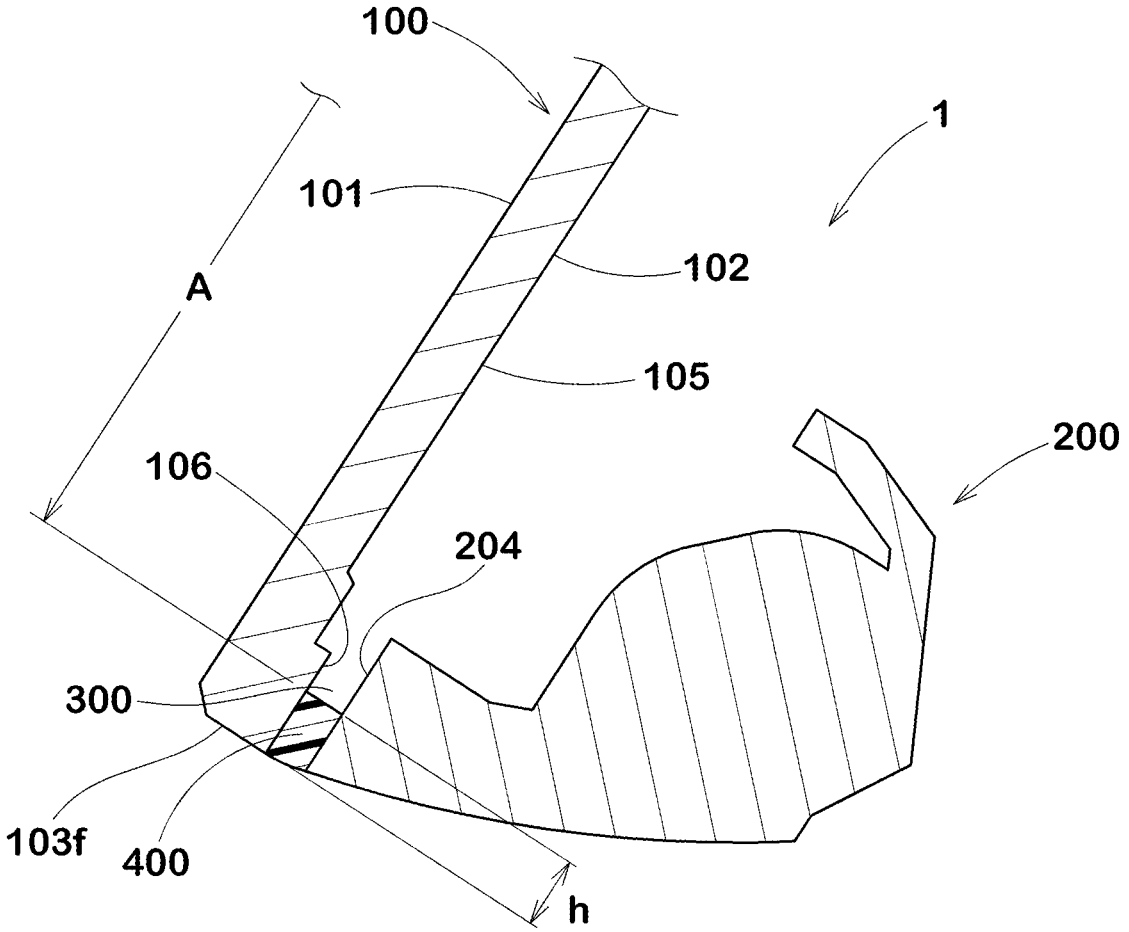
FIG. 13 is a cross-sectional view of the golf club head according to yet another embodiment.

FIG. 12 and FIG. 13 respectively show an exploded perspective view of the head 1 according to another embodiment and a cross-sectional view (corresponding to the location taken along the line III-III of FIG. 1) thereof. This embodiment differs from the previous embodiments in that the filling member 400 is arranged in at least a part of the gap 300.

As illustrated in FIG. 12, the filling member 400 according to the present embodiment comes into contact with both the face plate 100 and the head main body 200 (e.g., specifically, the recessed surface 204). Thus, the filling member 400 can adjust the deflection of the face plate 100 when striking a golf ball so that the rebound performance of the head 1 can be adjusted. The filling member 400 can be fixed to the gap 300 by various methods such as adhesive, screw, press-fitting, etc., for example.

The filling member 400 can adjust the rebound performance of the head 1 by changing the contact area and/or contact position with the face plate 100. For example, by increasing the contact area between the filling member 400 and the face plate 100, the rebound performance of the head 1 can be reduced. For example, as illustrated in FIG. 13, by changing a height h of the filling member 400 along the club face 2, the head vertical dimension of the flexible area A which is not supported by the head main body 200 of the face plate 100 can be adjusted.

Figure 14A:
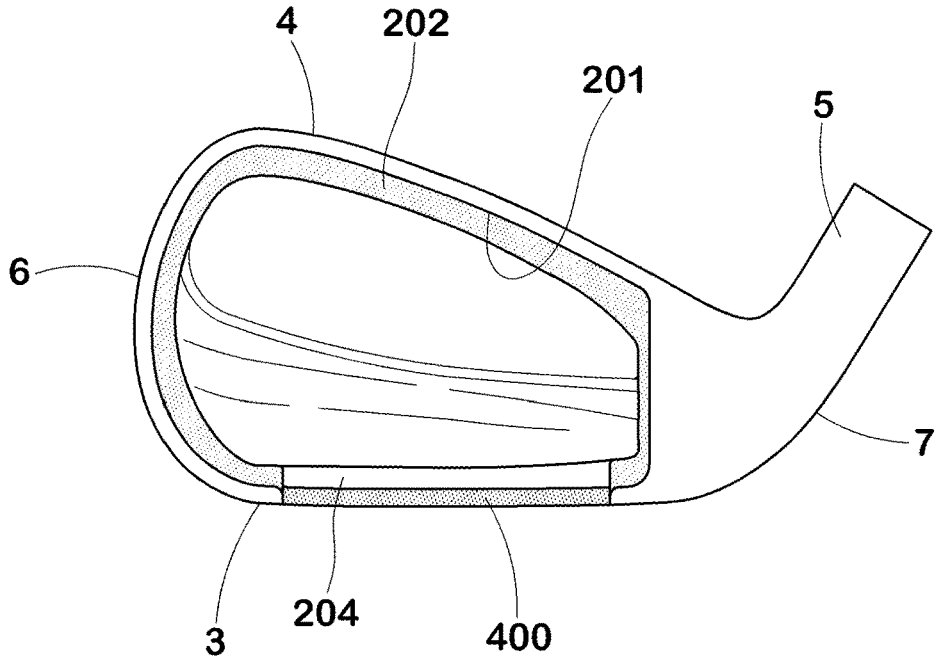
FIGS. 14A and 14B are front views of a head main body showing examples of a filling member.
Figure 14B:
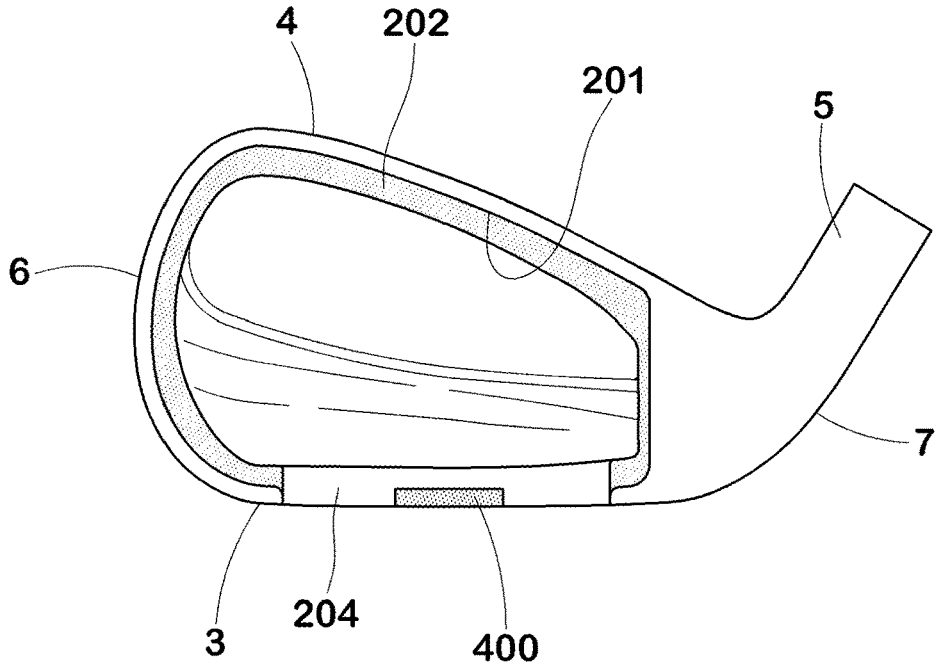

In addition, by contacting the filling member 400 to a position where the rebound performance of the club face 2 is high, the rebound performance of the contact position can be reduced locally. In FIG. 14A, the filling member 400 is located in the entire range of the toe-heel direction of the non-supported region 106. On the other hand, in FIG. 14B, the filling member 400 is arranged only in a part (e.g., a central part) in the toe-heel direction of the non-supported region 106.

Figure 15:
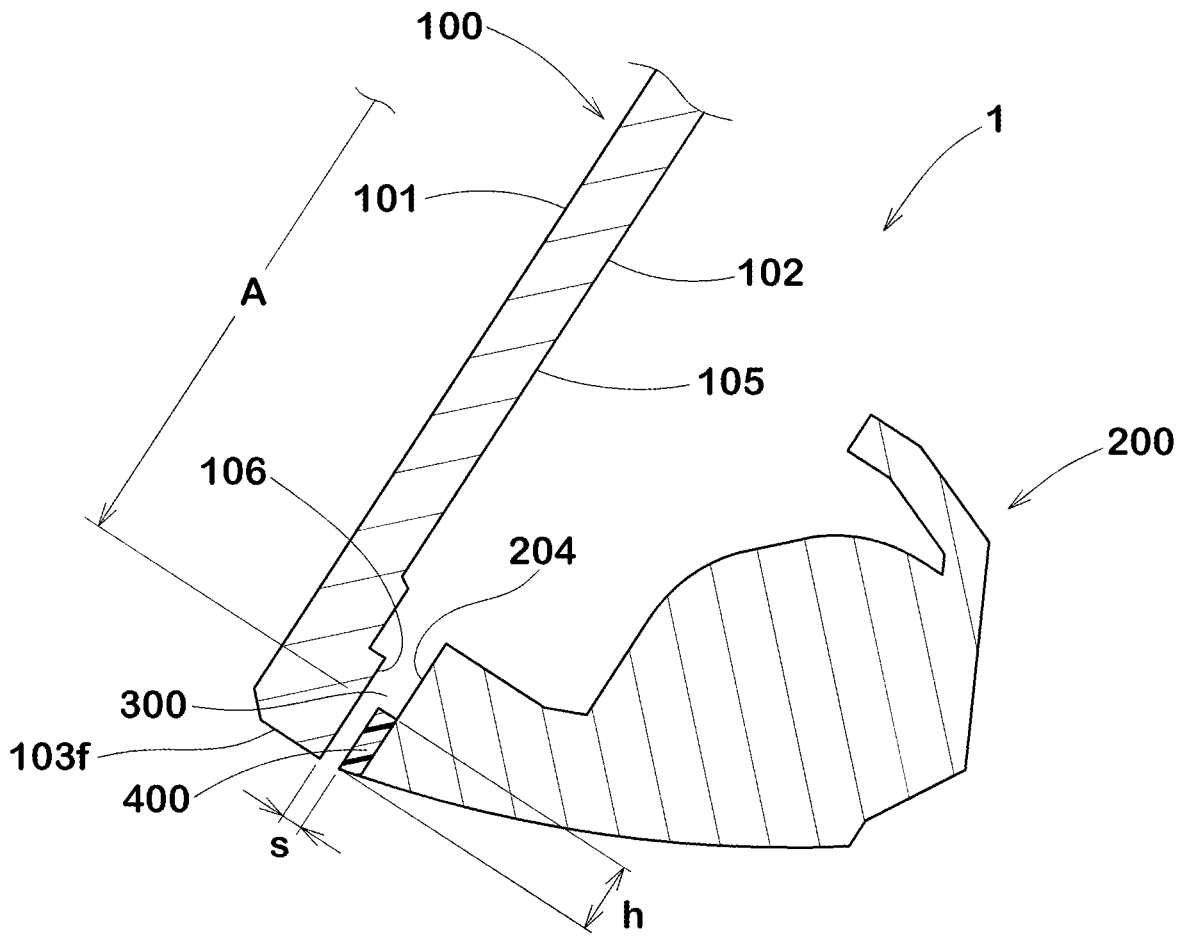
FIG. 15 is a cross-sectional view of the golf club head according to yet another embodiment.

Further, as illustrated in FIG. 15, the filling member 400 is in contact only with the head main body 200 (specifically, the recessed surface 204) and is not in contact with the non-supported region 106. The gap s between the filling member 400 and the face plate 100 is set such that the non-supported region 106 of the face plate 100 is in contact with filling member 400 when a golf ball is struck on the club face 2. Such a head 1 can adjust rebound performance of the head 1.

As described above, the shape and size of the filling member 400 can be appropriately determined according to the purpose of adjusting the rebound performance. In some preferred embodiments, a plurality types of the filling members 400 having different contact areas and/or contact positions with the face plate 100 may be prepared in advance. Then, one of the plurality of the filling member 400 may be arranged in the gap 300 according to the rebound performance required for the head 1 or the needs of the golfer.

Preferably, the Young's modulus of the filling member 400 is less than the Young's modulus of the face plate 100 and the head main body 200. In this case, the feel of hitting can be improved without impairing the rebound performance of the head 1. As such a filling member 400, an elastomer such as rubber or a resin can be preferable. Further, the filling member 400 may be a metal material having a small Young's modulus, e.g., aluminum or its alloy, or magnesium or its alloy.

Preferably, the specific gravity of the filling member 400 is greater than the specific weight of the face plate 100 and the head main body 200. Such an aspect helps to increase the weight on the sole 3 side and thus provide a lower head center of gravity.

In particularly preferred embodiments, the Young's modulus of the filling member 400 is smaller than the Young's modulus of the face plate 100 and the head main body 200, and the specific weight of the filling member 400 is greater than those of the face plate 100 and the head main body 200.

Furthermore, the filling member 400 may be a composite of a high specific gravity metal material with an elastomer or resin.

In some preferred embodiments, a method for manufacturing a club head 1 may include a process of fixing the face plate 100 and the head main body 200, a process of preparing a plurality types of the filling members 400 having different contact areas and/or contact positions with the face plate 100, a process of selecting one from the plurality of filling members 400 according to the rebound performance required of the head or the needs of the golfer, and a process of fitting the selected the filling member 400 to the gap 300.

Figure 16:
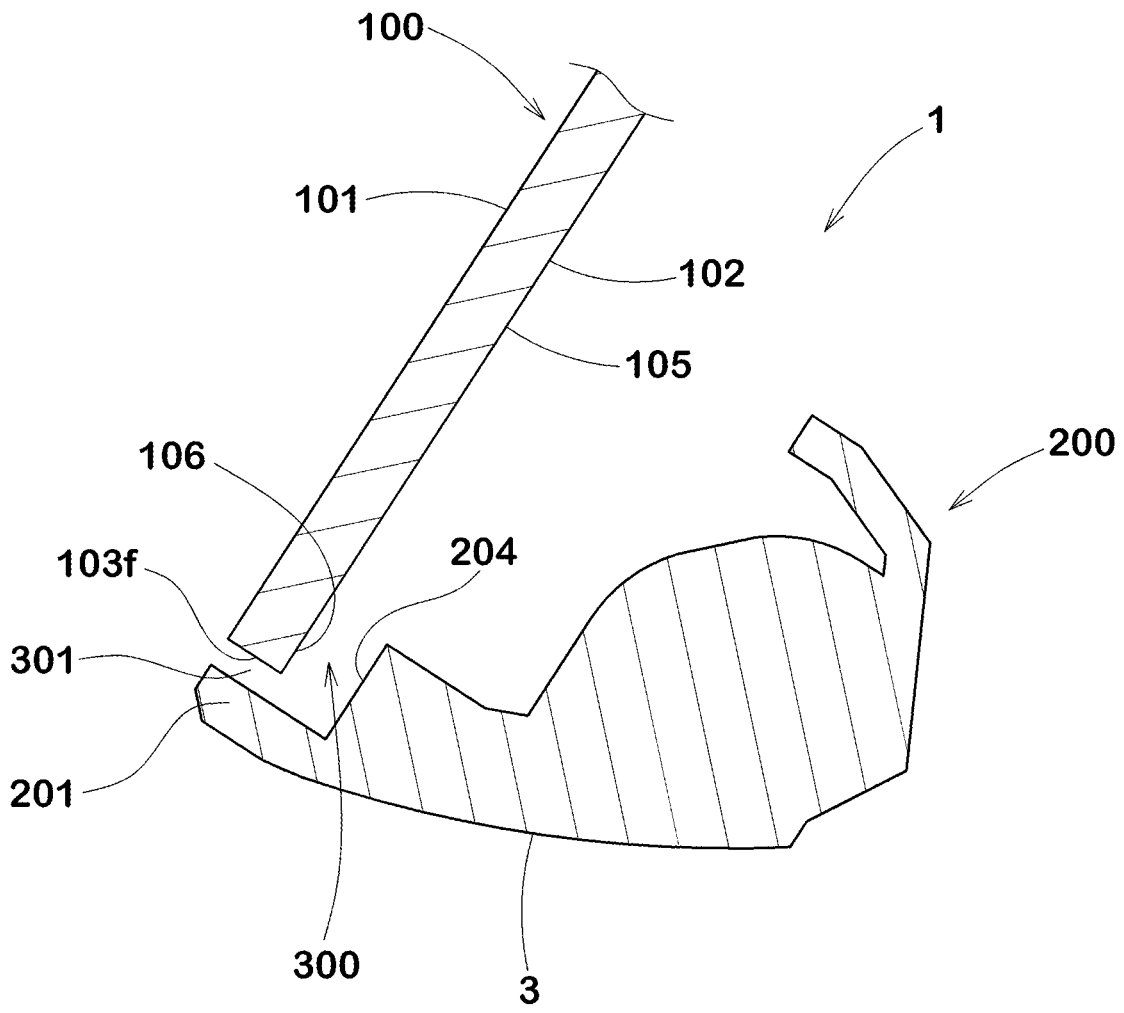
FIG. 16 a cross-sectional view of the golf club head according to yet another embodiment.

FIG. 16 illustrates yet another embodiment of the present disclosure. As illustrated in FIG. 16, the head main body 200 differs from the previous embodiment in that the head main body 200 has an extension 201. The extension 201 is formed so as to face the portion 103*f* of the plate side surface 103 corresponding to the non-supported region 106 of the face plate 100. As a result, the portion 103*f* does not form the outer surface of the sole 3. In addition, the extension 201 is arranged with the portion 103*f* via the gap 301 in the vertical direction so as not to support the plate side surface 103 directly.

While the particularly preferable embodiments in accordance with the present disclosure have been described in detail, the present disclosure is not limited to the illustrated embodiments, but can be modified and carried out in various aspects.

What is claimed is:

1. A golf club head comprising:

a face plate comprising a plate front surface constituting a club face at least partially, a plate rear surface opposite the plate front surface and having an outer peripheral portion, and a plate side surface extending between the plate front surface and the plate rear surface; and a head main body being provided with an opening to receive the face plate and a receiving surface formed around a periphery of the opening to support the outer peripheral portion of the plate rear surface, wherein the receiving surface is formed with a partially interrupted discontinuity so that the outer peripheral portion has a non-supported region that is not directly supported by the head main body, a portion of the plate side surface corresponding to the non-supported region is not directly supported by the head main body, the face plate is fixed to the head main body by a plastic deformation portion of the head main body, and a first gap is formed between the non-supported region and the head main body with a distance in a direction orthogonal to the club face, wherein the distance of the first gap is constant in a toe-heel direction of the golf club head, the head main body comprises an extension that is formed so as to face a portion of the plate side surface corresponding to the non-supported region of the face plate such that a second gap is formed between the extension and the portion of the plate side surface of the non-supported region in a vertical direction, and the second gap is in communication with the first gap.

2. The golf club head according to claim 1, wherein the non-supported region is formed on a lower side of the face plate.

3. The golf club head according to claim 1, wherein the plastic deformation portion of the head main body covers at least a portion of the plate front surface of the face plate.

4. The golf club head according to claim 1, wherein the face plate has a difference between a maximum thickness thereof and a minimum thickness thereof of 2.0 mm or less.

5. The golf club head according to claim 1, wherein the non-supported region extends in the toe-heel direction so as to extend across a vertical plane orthogonal to the club face and passing through a face center.

6. The golf club head according to claim 1, wherein the non-supported region comprises a toe-side non-supported region and a heel-side non-supported region, and the receiving surface comprises a center receiving surface formed between the toe-side non-supported region and the heel-side non-supported region.

7. The golf club head according to claim 6, wherein the center receiving surface extends in the toe-heel direction so as to extend across a vertical plane orthogonal to the club face and passing through a face center.

8. The golf club head according to claim 1, wherein a filling member is arranged in at least a part of the first gap and/or second gap.

9. The golf club head according to claim 8, wherein the filling member is arranged in an entire range of the non-supported region in the toe-heel direction.

10. The golf club head according to claim 8, wherein the filling member is arranged only in a part of the non-supported region in the toe-heel direction.

11. The golf club head according to claim 8, wherein Young's modulus of the filling member is smaller than Young's modulus of the face plate and the head main body.

12. The golf club head according to claim 1, wherein the club head has a wood, hybrid or iron head shape.

13. A golf club head comprising:

a face plate comprising a plate front surface constituting a club face at least partially, a plate rear surface opposite the plate front surface and having an outer peripheral portion, and a plate side surface extending between the plate front surface and the plate rear surface; and a head main body being provided with an opening to receive the face plate and a receiving surface formed around a periphery of the opening to support the outer peripheral portion of the plate rear surface, wherein the receiving surface is formed with a partially interrupted discontinuity so that the outer peripheral portion has a non-supported region that is not directly supported by the head main body, a portion of the plate side surface corresponding to the non-supported region is not directly supported by the head main body, the face plate is fixed to the head main body by a plastic deformation portion of the head main body, and a first gap is formed between the non-supported region and the head main body with a distance in a direction orthogonal to the club face, wherein the distance of the first gap varies in a toe-heel direction of the golf club head, a smallest portion of the first gap with a smallest distance is located between a toe-side end and a heel-side end of the non-supported region, the head main body comprises an extension that is formed so as to face a portion of the plate side surface corresponding to the non-supported region of the face plate such that a second gap is formed between the extension and the portion of the plate side surface of the non-supported region in a vertical direction, and the second gap is in communication with the first gap.

14. The golf club head according to claim 13, wherein the distance is set such that when the golf club head strikes a ball, the face plate and the head main body come into contact with each other at the smallest portion of the first gap.

15. The golf club head according to claim 13, wherein the smallest portion of the first gap is equal to or less than 1.0 mm.

16. A golf club head comprising:

a face plate comprising a plate front surface constituting a club face at least partially, a plate rear surface opposite the plate front surface and having an outer peripheral portion, and a plate side surface extending between the plate front surface and the plate rear surface; and a head main body being provided with an opening to receive the face plate and a receiving surface formed around a periphery of the opening to support the outer peripheral portion of the plate rear surface, wherein the receiving surface is formed with a partially interrupted discontinuity so that the outer peripheral portion has a non-supported region that is not directly supported by the head main body, a portion of the plate side surface corresponding to the non-supported region is not directly supported by the head main body, the face plate is fixed to the head main body by a plastic deformation portion of the head main body, and a first gap is formed between the non-supported region and the head main body with a distance in a direction orthogonal to the club face, the head main body comprises an extension that is formed so as to face a portion of the plate side surface corresponding to the non-supported region of the face plate such that a second gap is formed between the extension and the portion of the plate side surface of the non-supported region in a vertical direction, the second gap is in communication with the first gap, wherein a filling member is arranged in at least a part of the first gap and/or second gap, and wherein a specific gravity of the filling member is larger than specific gravities of the face plate and the head main body.

* * * * *